United States Patent [19]

Anbergen et al.

[11] 4,068,838

[45] Jan. 17, 1978

[54] CONVEYOR AND THREE-ROLLER SHEET DEFLECTOR FOR SHEET DISTRIBUTOR

[75] Inventors: Henricus J. Anbergen, Arlon, Belgium; Peter McCabe, Godalming, England

[73] Assignee: Addressograph-Multigraph Corporation, Cleveland, Ohio

[21] Appl. No.: 708,854

[22] Filed: July 28, 1976

[51] Int. Cl.[2] ..... B65H 29/60

[52] U.S. Cl. ..... 271/173

[58] Field of Search ..... 271/173, 64; 270/58

[56] References Cited

U.S. PATENT DOCUMENTS 3,717,249 2/1973 Faley ..... 271/64 X

FOREIGN PATENT DOCUMENTS 2,413,908 10/1975 Germany ..... 271/173

*Primary Examiner*—Bruce H. Stoner, Jr.

*Attorney, Agent, or Firm*—Ray S. Pyle

[57] ABSTRACT

The sheet diverting mechanism of a roller conveyor and belt combination sheet distributor operates in a sequential belt depressing mode by a three-roller deflector in a triangular configuration. The diverting mechanism can move in the direction of paper flow or counter thereto. The mechanism revolves about the roller centers, rather than to rotate about the center of the configuration. It follows a cyclic curved series of paths, producing a deflection of a subsequent belt area at a rate equal to a withdrawl of a prior belt area. The structure holding the roller deflector has great angular tolerance once the roller is in deflecting position. The two rollers, not in operation, can stop within several angular degrees.

5 Claims, 6 Drawing Figures

CONVEYOR AND THREE-ROLLER SHEET DEFLECTOR FOR SHEET DISTRIBUTOR

BACKGROUND OF THE INVENTION

The mechanical distribution of paper sheets is a necessary procedure to implement the communication procedures of modern business.

Collation is one distribution function, but sorting and distribution according to a program are also paper sheet handling problems. Hence, such equipment is improperly labeled a collator, unless that is its only capability.

The first step away from an operator walking around a table to place one sheet on each of several stacks, was the use of a vertical set of shelves. The operator placed a stack of each page on each shelf, and then withdrew one after the other in sequence to compile a "book".

Mechanical implementation has generally mimicked the first human system, by directing one sheet at a time to series of pockets until all of the one page has been placed. Then sheet two is likewise distributed. A program added to such a system will permit true distribution. Multiple copies into one pocket, single in another, and none to yet another.

The sheets are conveyed along a path. This conveyor aspect of sheet distribution is not difficult. But to cause the sheets to separate from the conveyor and go into a selected pocket is a source of potential problems. Paper often jams.

SUMMARY

The main advantage of this invention, and an object to be obtained, is to convey sheets along a conveyor, and to deflect the sheets into lateral openings in the conveyor at designated locations, to thereby direct the sheets into receiving pockets.

It is an object of the invention to provide the conveyor as a roller conveyor and to convey sheets along the roller conveyor bed by driving the rollers and a web lying thereon together at substantially the same speed, and depressing the web between rollers at designated exit points along the conveyor.

It is a principal object of the invention to operate the exit selection by deflecting a subsequent location of the web at a rate equal to the rate a prior location is allowed to withdraw, so that the web will maintain a fixed composite length.

DESCRIPTION OF THE PREFERRED EMBODIMENT

Figure 1:
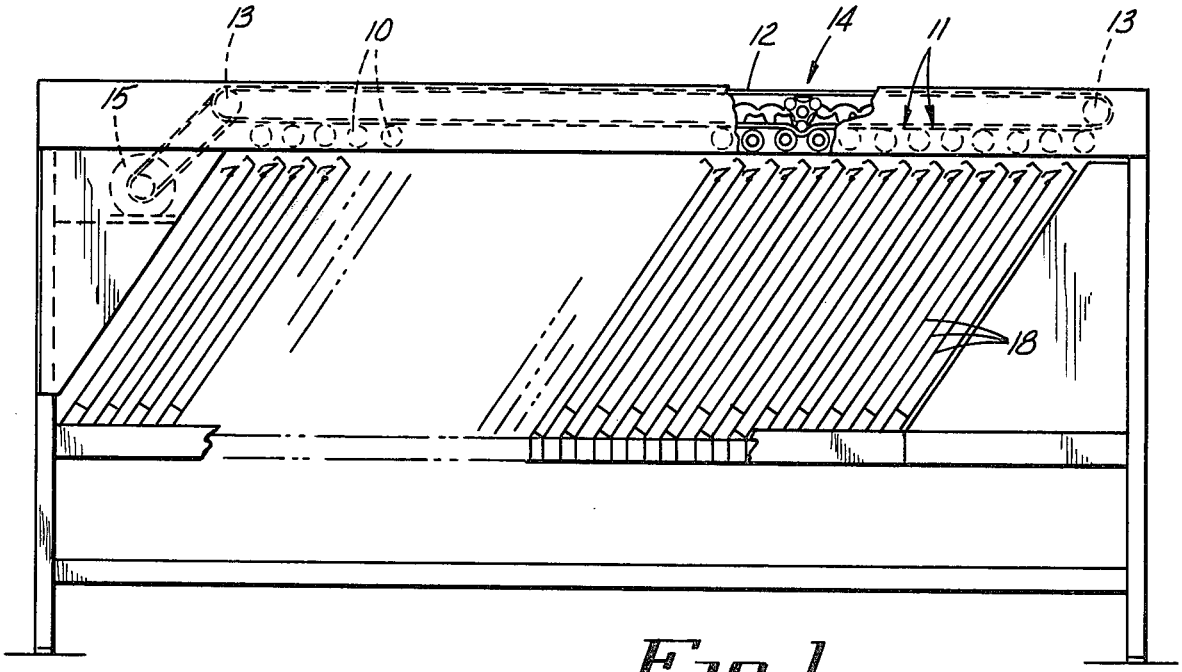
FIG. 1 is a general schematic side illustration of the preferred embodiment of a distributor employing the improvement of the present invention.

This invention describes a means of deflecting sheets of paper into selected pockets. The sheets are conveyed along a series of rolls 10 by means of a belt 12 (or belts) above and in close contact with the sheets. Downward deflection of the paper between any selected pair of conveyor rolls is achieved by a deflector system 14, having three rollers 16, which can be positioned between said rolls to press the belt out of line and cause the sheets to be directed between said rolls into a receiving pocket 18.

This deflector system 14 can be moved to the next position after a sheet passes, so that the following sheet enters into the next pocket. The deflecting system is made so that:

1. The length of the belts is not affected when the deflector is moving;

2. A large variation in the position of the deflector rollers 16 does not affect the exit angle of the sheet into the pocket.

The three rollers 16 of this deflector system 14 are placed at an angle of 120° and fixed to two side plates 20 kept parallel by a central shaft 22. The shaft 22 is attached at its ends to a pair of cam rollers 24. Rollers 24 are of modified delta configuration having sides which are arcs of a circle rather than straight. This produces a cycloidal movement of the system 14. When these sides roll on a flat surface parallel to the conveyor path, the deflector rolls 16 at each corner, on pressing the belts between the conveyor rolls, maintain a constant length displacement on the belts. That is, as one deflector roll disengages from a pair of conveyor rolls the next deflector roll on the triangle begins to press the belt between the following two conveyor rolls so that the "bulge" of the belt is moved progressively to that new position and that deflector roll is in full engagement as soon as the arc becomes tangential to the flat surface at the axis of that roll.

Having rolled along the arc of cam rollers 24 until the next deflector roll is fully engaged, linear displacement of the deflector system 14 is obtained by pivoting of the system about the engaged roll 16 until the next roll 16 touches the belt and the following arc on cam rollers 24 corresponding to the position between the two lower displacement rolls begins to contact the aforementioned flat surface. It will then be seen that this rotation covers 90° where the engaged roll remains in position to deflect paper effectively.

The deflector assembly may be controlled such that the arcular triangle is kept always in contact "rolling" along the flat surface by means of a cam system or magnets or by its sheer weight, but in the preferred embodiment, a mechanical cam system 26 is preferred as shown on the drawings.

A belt depressing distributor system has been disclosed in application Ser. No. 554,821 filed Mar. 3, 1975, now U.S. Pat. No. 4,006,894 issued Feb. 3, 1977 entitled: SYSTEM FOR SHEET SORTING IN COLLATING POCKETS. The inventors are Raible, Dioer, and Lehmann.

In that system, the deflecting elements or rolls rotate about their common center, and the belt 12 is reaved about end rollers which are spring loaded to allow for the sequential depressing of the belt web.

Because the general concept of conveying and distributing sheet material into pockets is old and wellknown, the drawings of this application are abbreviated to illustrate only the essentials of the actual operating machine which the drawings are intended to illustrate. The principles set forth herein are operative and very successful.

In the FIG. 1 the sheet distributor construction is shown as a conveyor table providing an elongated sheet transport path. The table, in the preferred embodiment, is composed of a plurality of rollers 10 substantially similar to conventional package conveying roller systems known to industry. The plurality of surfaces establishes a plane and therefore the table is said to be composed of a plurality of surfaces defining a plane.

The rollers are preferably driven in unison by a common drive system from a motor 15, but the drive system is not illustrated in these drawings.

The rollers 10 are separated and therefore define a series of transverse openings which define sheet exit chutes. These areas are indicated by the reference character 11 in FIGS. 1 and 3.

Figure 3:
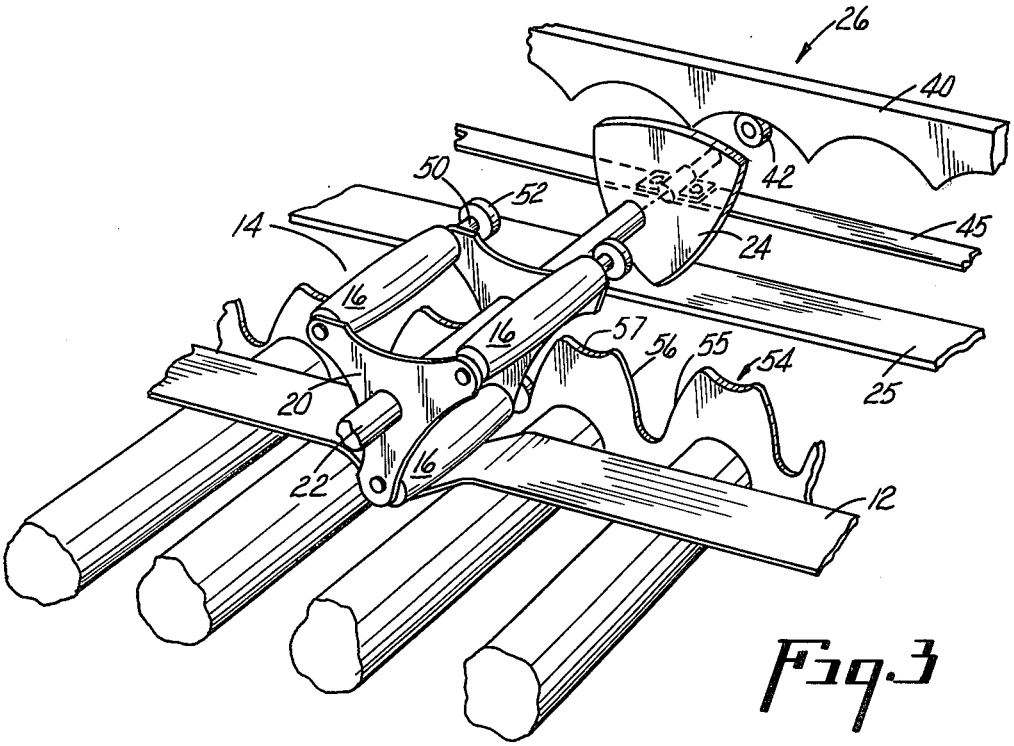
FIG. 3 is a detailed and exploded perspective view of one of the deflector system members in cooperation with a roller conveyor.

The belt 12, which is generically a flexible elongated web, is preferably in close contact with the rolls 10, and in practical construction rests upon or substantially rests upon the top surfaces of the rolls 10, and bridges the transverse openings, as shown in FIGS. 1 and 3.

Figure 2:
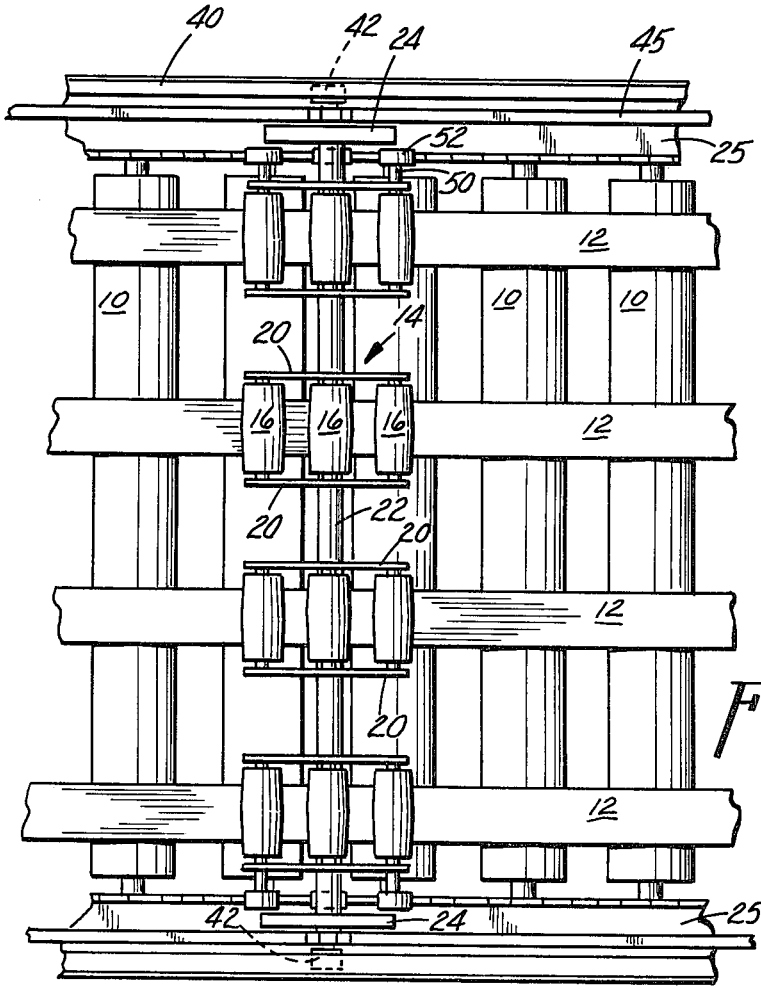
FIG. 2 is a top plan view of the conveyor and deflecting system.

Although one belt 12 will operate in exactly the same manner as a plurality of belts shown in FIG. 2, only a very limited capacity machine would normally employ a single belt. The single belt of FIG. 3 is one of the four belts shown in FIG. 2, enlarged for illustration of detail.

The belts 12, whether one or a plurality, are driven about end rollers 13 by means of a prime mover 15 as shown in FIG. 1. A takeoff from this same power system, as referred before, drives the rolls 10 in unison with the speed and direction of the belt in contact therewith. Thus, a sheet of paper which enters into the conveyor system, will be transported along the transport path on the plane of the surfaces of the rolls by being clamped between the rolls and the belt. Because of the closeness of the space between the rolls and the inherent stiffness of paper sheets being transported, the paper will bridge the spaces between the rolls and will normally move along the transport path without being deflected into the transverse openings.

The improvement of this invention is incorporated into the apparatus and method for deflecting portions of the belt web into the transverse openings in sequence, in a novel and superior manner. At least two deflecting elements would be required to carry out the method broadly, but the preferred embodiment illustrated is built around the deflector system 14 composed of two side plates 20 which mount the rollers 16 in a triangular relationship equally spaced around a central axis provided by the shaft 22.

However, the system 14 does not rotate around the central axis provided by shaft 22, but rather the shaft 22 is in turn mounted centrally of two cam rollers 24. Cam rollers 24 produce a cycloidal movement of the system 14.

The cam rollers 24 roll along a longitudinal support 25 to produce the cycloidal movement.

Figure 6:
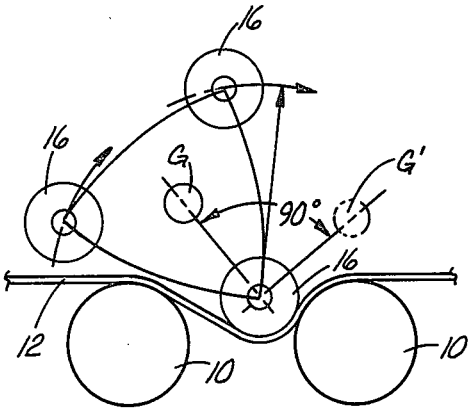
FIG. 6 is a second position and mode of operation which follows after that of FIG. 5.
Figure 5:
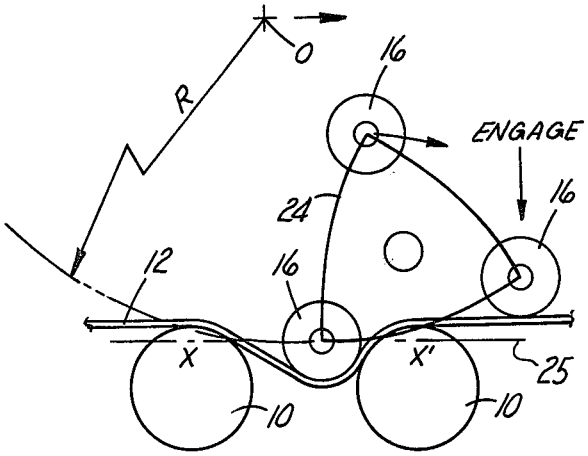
FIG. 5 is a diagram illustration of the unique deflector system movement during one portion of the operation.

Refer to FIGS. 5 and 6. The unique movement of the deflecting elements is best illustrated in these figures.

In FIG. 5 the shape of the cam rollers 24 is superimposed upon the position of the rollers 16, and the path 25 is shown in relationship to the rolls 10. Assuming the movement to be from left to right in the illustration, the circular segment of plates 20 related to the position between the two rollers 16 which are in engagement with the web belt 12, is shown rolling upon the surface 25. Hence, as movement takes place the center of the cam roller 24 will lift with respect to the surface 25 and revolve in an upwardly and right directional path. This movement will cause the roller 16 on the left side to begin disengaging the belt 12 and the one on the right side to begin engaging, and the disengagement will be at the same rate and in increments equal to the engagement.

Reference to the FIG. 6 will also illustrate that after the roller has reached the lowermost point of its travel between two adjacent rolls 10, further movement of the system 14 will be a rotational movement about the center of the roller 16 which is located between two rolls. Note the arrow showing the continuing cycloidal movement of the center of the cam roller 24. During this portion of the movement, the center will be moved through 90° of a circular path, and then due to the cycloidal movement of the system 14, will begin an upward movement in a new circular segment.

The belts 12 will exert a strong lifting action on the system 14, and therefore means must be provided to keep the system 14 in its proper location. If the system could be made extremely heavy, or other weight simulating means such as magnets were employed, the force of the belts could be overcome. The preferred embodiment has resorted to a simple cam system 26 which provides a guide path. A scalloped appearing series of circular segment is provided in the bottom surface of a cam guide 40 shown in FIG. 3. The central shaft 22 is fitted with a roller 42 and positioned under the segments of the guide 40.

Figure 4:
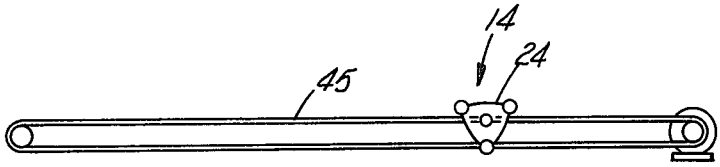
FIG. 4 is a diagrammatic illustration of a system drive.

Also, in order to provide forward movement of the system 14, the shaft 22 is attached to a drive belt 45 as illustrated by the attachment device shown in phantom view directly behind the cam roller 24 in FIG. 3. FIG. 4 illustrates the closest loop configuration of belt drive 45. The drive 45 is a flexible belt and therefore can move with the cycling movement of the shaft 22 and yet provide the forward drive movement necessary. The belt 45 is integrated into the drive system from the motor 15.

The rollers 16 are mounted on axles 50 and the axles 50 carry end rollers 52. Rollers 52 are guided by cam track 54 which has side guide surfaces 55 and 56 at each deflecting position. The bottom roller 16 in FIG. 3 is shown in a position with its roller 52 located at the apex of the guide cam between the surfaces 55 and 56. This guide surface assures proper register of the rollers 16 with the transverse space openings between the rolls 10. The peaks of the cam track, indicated by reference character 57 are depressed to provide clearance for the movement of the shaft member 22.

Although shown in its preferable form of a three-roller system, and also shown as a multiple series of individual systems 14 rather than one long system, the essence of the structure described is simply a means which has at least two deflecting elements to deflect portions of the belt web into the transverse openings of a conveyor surface in sequence, and include means to so coordinate the sequential deflecting application of the element that after the web is fully deflected by one element 16 and begins to withdraw, another element subsequently deflects a portion of the web into the succeeding transverse opening at a rate equal to that of the rate of withdrawal of the one element 16.

What is claimed is:

1. A sheet distributor, comprising:

a plurality of spaced conveyor bed members aligned to define an elongated transport path in a plane tangent to the spaced members, the space between the members being gates from the transport path;

at least one belt web traveling about end guides of fixed position, resting on the bed members and bridging the spaces therebetween to clamp sheets between said belt and the conveyor bed members;

drive means for driving said belt web in a conveying direction to convey sheets along the transport path;

a three-roller deflector assembly with the rollers thereof spaced in equiangular relationship;

means for revolving and advancing the assembly along said path over said belt web;

means to guide said assembly in a cyclic path which causes the assembly to plunge one roller fully into one said space until the belt is contained without appreciable slack in its path, and thereafter pivot about that one roller as it remains in position until a subsequent roller is brought into contact with the belt at the subsequent space, whereafter the one roller is retracted at a rate equal to the rate of insertion of the subsequent roller, whereby, the belt is maintained deflected for an extended period of time in each space and the belt is never permitted to become slack.

2. A sheet distributor as defined in claim 1, wherein there are a plurality of web belts resting on said conveyor bed members, and there is a separate three-roller deflector assembly for each belt, but all deflector assemblies are on one central shaft and operated by the same means to advance and revolve the assemblies.

3. A sheet distributor defined in claim 1, wherein the bed members are rolls in a conveyor configuration.

4. A sheet distributor defined in claim 1, wherein the bed members are in a race conveyor configuration; and said means to guide said assembly including a cam track means for guiding the rollers in their plunge and retract paths and a cam track follower carried on the axis of each roller of the assembly.

5. A sheet distributor defined in claim 1, wherein the bed members are in a roll conveyor configuration; and said means to guide said assembly including a cam track means for guiding the rollers in their plunge and retract paths and a cam track follower carried on the axis of each roller of the assembly; and the deflector assembly having a central axis shaft with a three-sided cam on each end shaped to produce a cycloidal path of travel coordinated with the cam track means guiding the rollers of the assembly.

* * * * *